US006513491B1

(12) United States Patent
Harvey

(10) Patent No.: US 6,513,491 B1
(45) Date of Patent: Feb. 4, 2003

(54) ELECTRONIC THROTTLE CONTROL LINKAGE WITH LIMP HOME MECHANISM

(75) Inventor: Bruce James Harvey, Shelby Township, MI (US)

(73) Assignee: Siemens VDO Automotive Inc., Tilbury (CA)

( * ) Notice: Subject to any disclaimer, the term of this patent is extended or adjusted under 35 U.S.C. 154(b) by 167 days.

(21) Appl. No.: 09/687,306

(22) Filed: Oct. 13, 2000

Related U.S. Application Data

(60) Provisional application No. 60/159,852, filed on Oct. 15, 1999.

(51) Int. Cl.[7] ..... F02D 41/00
(52) U.S. Cl. ..... 123/361; 123/399
(58) Field of Search ..... 123/361, 396, 123/399, 400

(56) References Cited

U.S. PATENT DOCUMENTS

| | | | | |
|---|---|---|---|---|
| 2,488,096 | A | | 11/1949 | Newman |
| 2,509,093 | A | | 5/1950 | Field |
| 4,776,313 | A | | 10/1988 | Freismuth et al. |
| 4,805,564 | A | | 2/1989 | Hudson, Jr. |
| 5,003,933 | A | | 4/1991 | Rush, II et al. |
| 5,163,406 | A | | 11/1992 | Daly et al. |
| 5,189,782 | A | | 3/1993 | Hickey |
| 5,209,204 | A | | 5/1993 | Bodenhausen et al. |
| 5,211,149 | A | | 5/1993 | DeGrace, Jr. |
| 5,218,936 | A | | 6/1993 | Pritz et al. |
| 5,295,468 | A | | 3/1994 | Blessing et al. |
| 5,323,749 | A | | 6/1994 | Gras et al. |
| 5,349,930 | A | | 9/1994 | Maruyama et al. |
| 5,353,767 | A | | 10/1994 | Carbone et al. |
| 5,357,931 | A | | 10/1994 | Semence |
| 5,447,140 | A | | 9/1995 | Brisbane et al. |
| 5,598,824 | A | | 2/1997 | Treusch et al. |
| 5,775,292 | A | | 7/1998 | Seeger |
| 5,778,853 | A | * | 7/1998 | Saito ..... 123/361 |
| 6,050,241 | A | * | 4/2000 | Reiling ..... 123/396 |
| 6,341,593 | B2 | * | 1/2002 | Kamimura ..... 123/337 |
| 6,349,701 | B1 | * | 2/2002 | Sakuri et al. ..... 123/361 |
| 6,360,718 | B1 | * | 3/2002 | Wicker ..... 123/396 |
| 6,390,062 | B1 | * | 5/2002 | Saito et al. ..... 123/361 |

FOREIGN PATENT DOCUMENTS

| | | |
|---|---|---|
| DE | 4039937 A | 6/1992 |
| DE | 4029526 A | 3/1993 |
| DE | 4141104 A | 6/1993 |
| EP | 0525376 A | 2/1993 |
| EP | 0828067 A | 3/1998 |

* cited by examiner

*Primary Examiner*—John Kwon

(57) ABSTRACT

The subject invention is a linkage assembly for an electronically controlled throttle (ETC) that provides for the precise setting of a limp home engine speed for a vehicle. Essentially a controlled amount of movement is attained between a closed position and a limp home throttle position. A throttle valve is attached to a first shaft and rotates to regulate air intake. The first shaft is attached to a sector gear. The sector gear is driven by the ETC. A stop bracket limits the amount that the sector gear can close the throttle valve. The stop bracket defines an opening, and a cam is disposed within the opening. A spring biases the stop bracket against the cam. Normally, the ETC can overcome the spring and the stop bracket is forced against the cam such that stop bracket contacts the cam to define a closed throttle position. Of course, when operational the ETC can drive the valve to open position as demanded by the vehicle. The limp home engine speed is set by a preset by the difference between the length of the opening of the stop bracket and a width of the cam. If the ETC becomes disabled, there is not enough force to overcome the spring and move the sector gear to the closed throttle position, instead the sector gear remains at the second stop position to provide the limp home engine idle speed that allows a driver to sufficiently maneuver the vehicle.

17 Claims, 3 Drawing Sheets

ELECTRONIC THROTTLE CONTROL LINKAGE WITH LIMP HOME MECHANISM

This application claims priority to provisional application serial No. 60/159,852 filed on Oct. 15, 1999.

BACKGROUND OF THE INVENTION

This application discloses an improved limp home feature for an electronic throttle control. An electronic throttle control (ETC) replaces mechanical throttle linkage to control opening of the throttle valve. The throttle valve actuated by the ETC is opened proportionally according to signals received from a sensor placed on an accelerator pedal. The ETC opens the throttle valve proportionally to movement of the accelerator pedal.

A typical ETC will be mounted to a throttle body. The throttle body includes a bore to intake air. The throttle valve is disposed within the bore to regulate the intake of air. The throttle valve is attached to a shaft rotatably mounted to the throttle body. Rotation of the shaft opens the throttle valve. The shaft will extend from the throttle body to attach to the ETC. A precision stop for a closed throttle position is set to provide a minimum airflow requirement for an engine. The minimum airflow requirement will put an engine at or near a stall condition. The air passage can be opened to a greater extent by the valve to provide additional airflow as required for specific engine operating conditions.

In an ETC application a second throttle position is set when power is removed from the ETC. The second throttle position provides an engine speed that will produce enough power that can easily be controlled by a driver. This second position is referred to by those knowledgeable in the art as the limp home throttle valve position. The intent of the limp home position is to provide the driver with sufficient power to maneuver the vehicle.

The engine speed required for the limp home setting must be set precisely, because a limp home engine speed that is too low will not provide the necessary engine power to maneuver the vehicle. Alternatively, too high an engine speed may create a sensation in the driver of being out of control of the vehicle. For these reasons it is desirable and necessary to provide a mechanism that provides for the precise reliable setting of both the closed throttle valve position and the limp home throttle valve position for an ETC.

SUMMARY OF THE INVENTION

The subject invention is an electronic throttle control with a linkage assembly that provides for the precise setting of a closed throttle valve position and a limp home throttle valve position. Essentially, an arrangement allows a precise amount of throttle movement from a closed throttle position to the limp home throttle position when the ETC motor is disabled. The linkage assembly is preferably mounted to the side of a throttle body. The throttle body includes a bore having a first shaft that extends through the bore. A throttle valve is attached to the first shaft within the bore and rotates with the first shaft to regulate air intake. A lever is rigidly attached to the first shaft. The lever is driven by an electronic throttle control. A stop bracket provides for a precision first stop position of the lever in the throttle valve closing direction. The stop bracket includes first and second arms that define an opening. The opening includes a length between inner surfaces of the first and second arms. A stop is mounted to a pin and disposed within the opening of the stop bracket. A biasing member biases the stop bracket in an open throttle direction. The ETC overcomes the biasing member in the closed throttle direction to reach the first stop position. The first stop position corresponds to the closed throttle position. The stop is adjustable to allow for setting of the first stop position. The limp home engine speed is set by the second stop position of the stop bracket. The second stop position is a predetermined distance from the first stop position that remains the same regardless of the setting of the first stop position. The predetermined distance between the first stop position and the second stop position is a difference between a width of the opening and a width of the stop. The biasing member possess enough force to overcome all forces in the closing throttle position except for those forces exerted by the ETC. Upon loss of power to the ETC the biasing member will force the stop bracket to the second stop position, and thereby move the lever and throttle valve to a limp home position.

The subject invention overcomes the deficiencies of the prior art by providing a simple, precise, reliable and cost effective linkage assembly for setting both the closed throttle and the limp home throttle positions.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
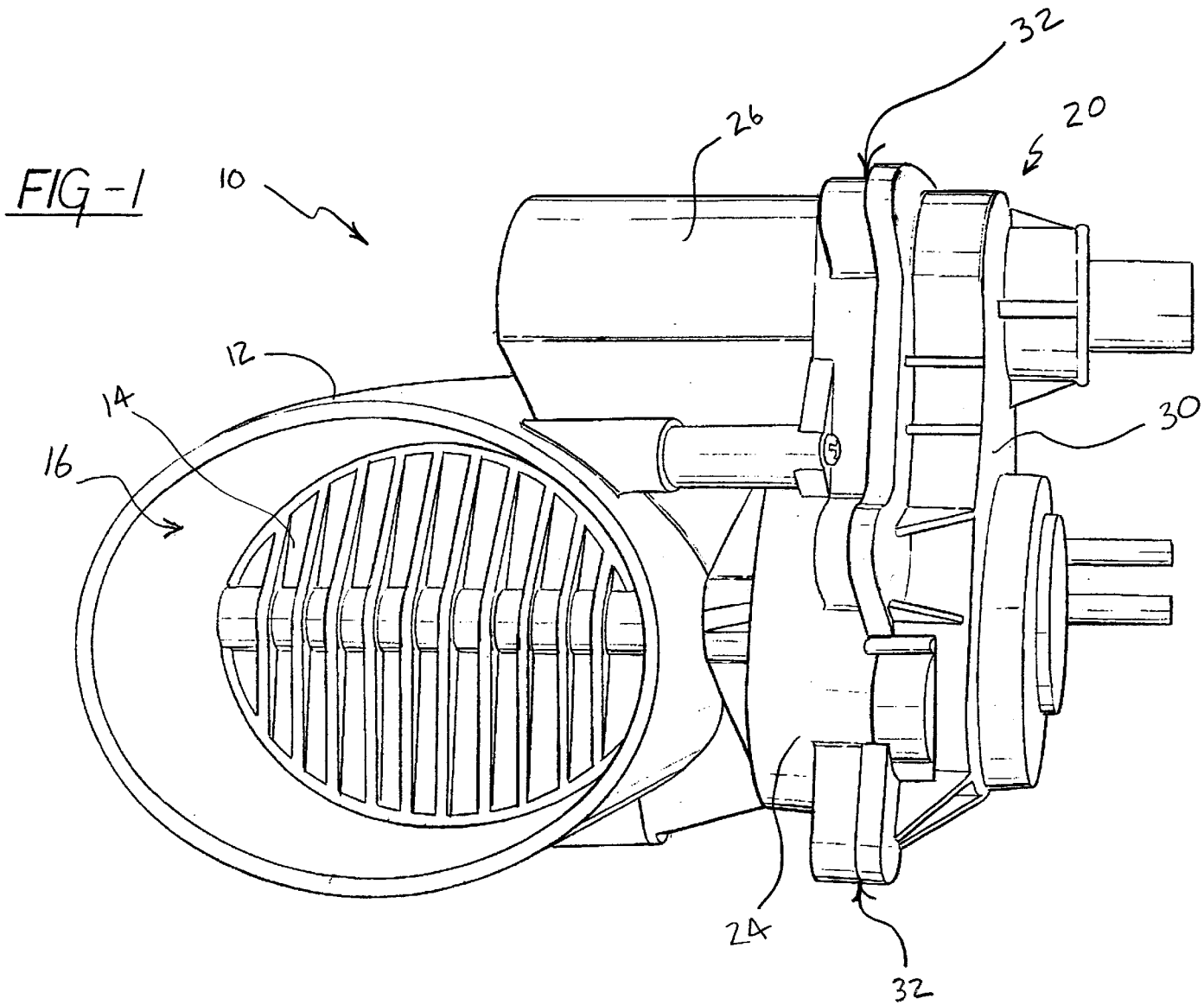
FIG. 1 is a perspective view of a throttle body with Electronic Throttle Control.

Referring to the FIGS., wherein like numerals indicate like or corresponding parts throughout the several views, where the subject invention is an electronically controlled throttle assembly 20 with linkage that provides for the precise setting of a limp home throttle valve position is generally indicated at 10. The electronic throttle control assembly 20 includes a throttle body 12 having a throttle valve 14 mounted within a bore 16 to a first shaft 18 and actuated by an electric motor 26 through a linkage assembly 22. The electronically controlled throttle assembly 20. Referring to FIG. 1, the bore 16 of the throttle body provides for the intake of air. The first shaft 18 extends through the bore 16. The throttle valve 14 regulates the flow of air through the bore 16 of the throttle body 12.

Figure 2:
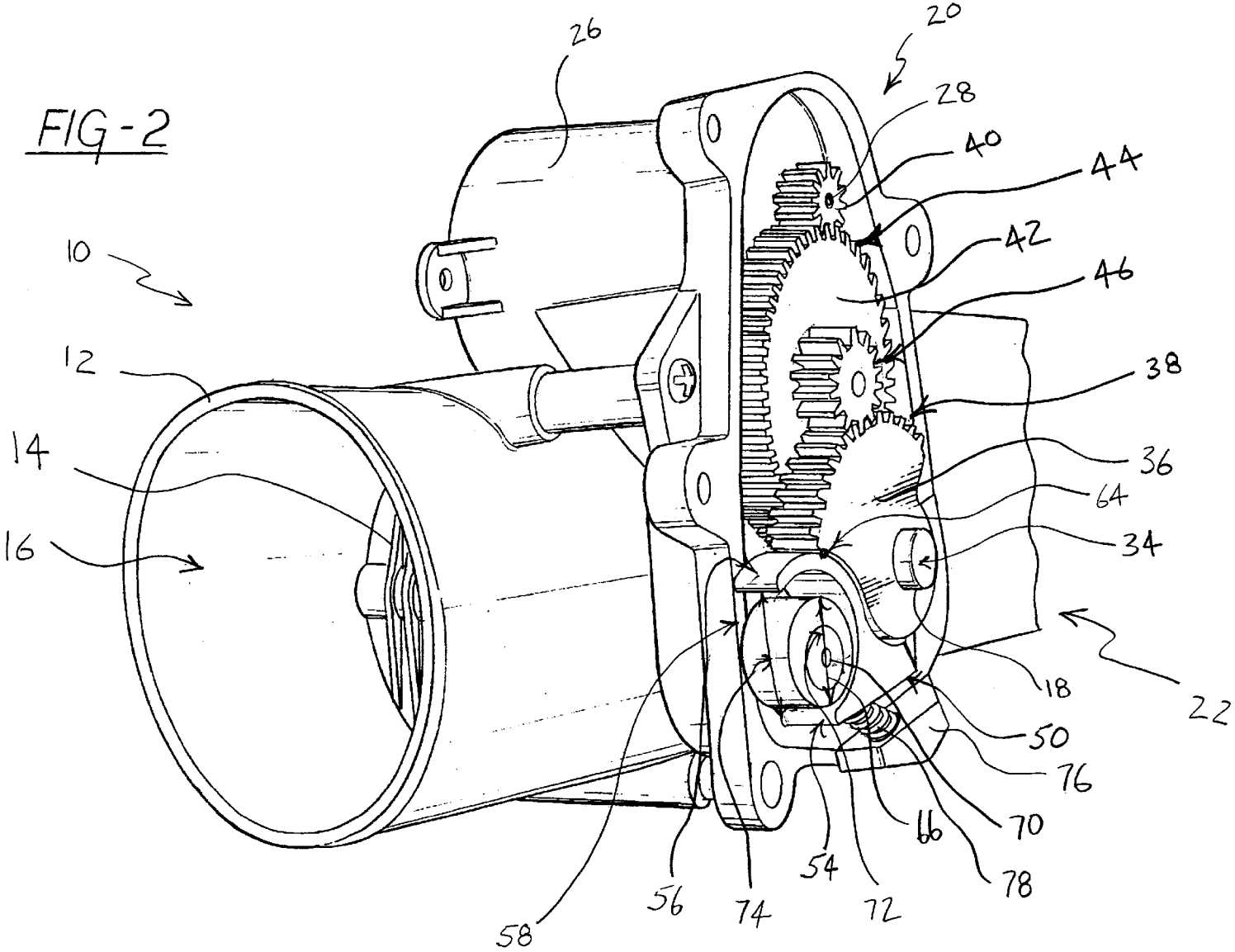
FIG. 2 is a perspective view of the limp home linkage mechanism.

Referring to FIG. 2, a housing 24 is mounted to a side of the throttle body 12. The ETC assembly 20 includes an electric motor 26 secured to the housing 24. The electric motor 26 drives a linkage assembly 22 through drive shaft 28, which extends into the housing 24. A cover 30 is secured to the housing 24 with a fastening means 32.

Figure 3:
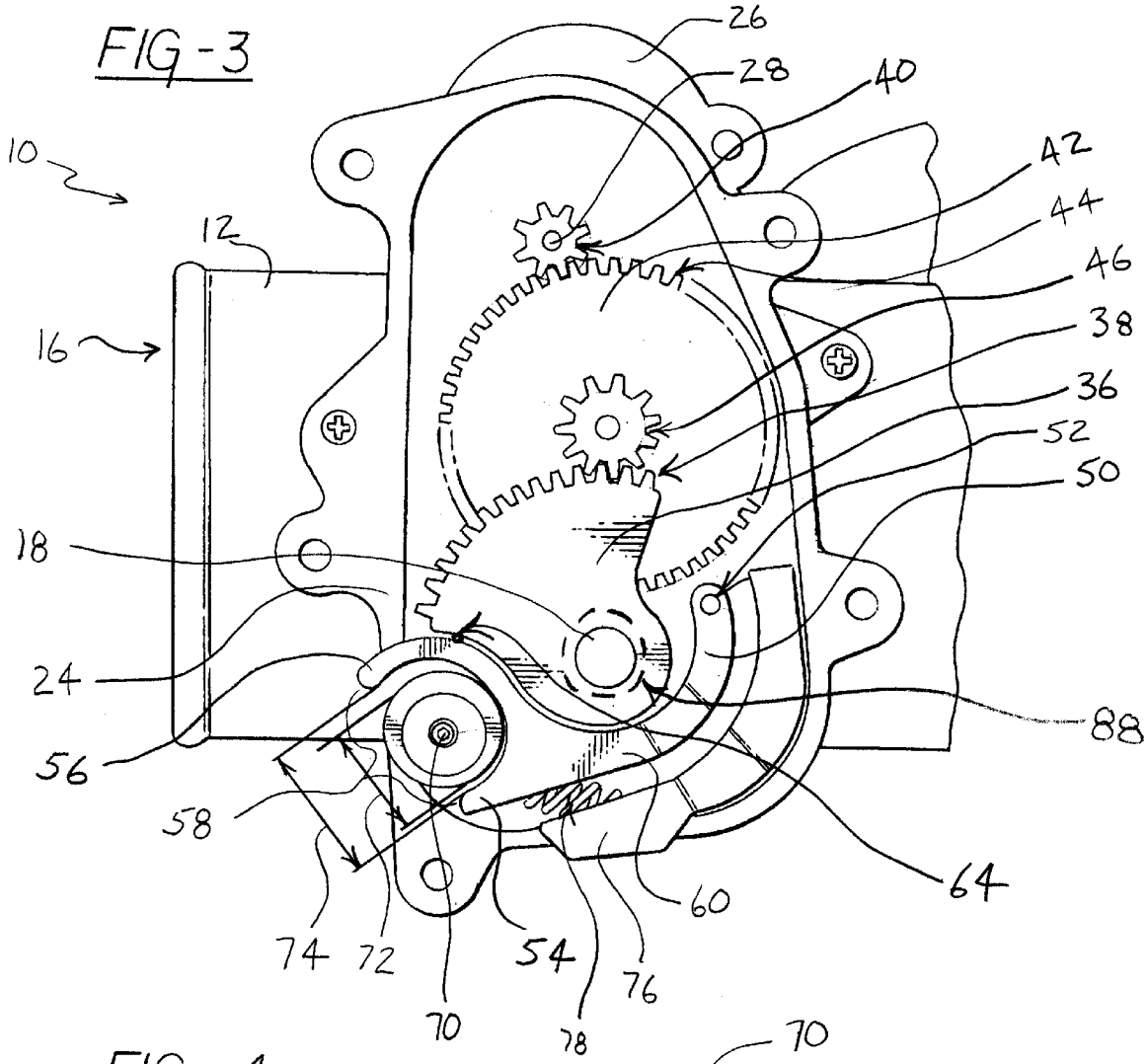
FIG. 3 is a top view of the entire ETC limp home mechanism.

Referring to FIG. 3, the first shaft 18 includes a first end 34 that extends through the bore 16 of the throttle body 12 and into the housing 24. A lever is attached to the first end 34 of the first shaft 18. The lever in the preferred embodiment is a sector gear 36 including gear teeth 38. The sector gear 36 is driven by the electric motor 26 through at least one drive gear. Specifically, a first drive gear 40 is mounted to the drive shaft 28 of the electric motor 26. A second drive gear 42 having a first and second plurality of gear teeth 44, 46 is rotatably mounted on a second shaft 48. The first drive gear 40 engages the first plurality of drive teeth 44 on the second drive gear 42. The second plurality of gear teeth 46 of the second drive gear 42 engages the gear teeth 38 of the sector gear 36. Rotation of the drive shaft 28 of the electric motor 26 rotates the sector gear 36 and thereby the first shaft 18. Rotation of the first shaft 18 facilitates the opening and closing of the throttle valve 14 within the bore 16. Rotation of the sector gear 36 is limited by contact with a stop bracket 50. A throttle return spring 78 is shown schematically on the sector gear 52 and biases the sector gear 36 against the stop bracket 50.

The stop bracket 50 is pivotally mounted to a pivot pin 52 within the housing 24 and includes first and second arms 54, 56 that define an opening 58 therebetween. The stop bracket 50 also includes a pivot arm portion 60 from which the first and second arms 54,56 extend. The pivot pin 52 is preferably located as close to the first shaft 18 as possible and inline with a point of contact 64 between the sector gear 36 and the stop bracket 50. The location of the pivot pin 52 is determined such that movement of the first and second arms 54, 56 of the stop bracket is essentially linear over the range of movement of the stop bracket 50. Further, the length of the pivot arm portion 60 provides a mechanical advantage that reduces any effect of friction on movement of the stop bracket 50.

A stop is disposed within the opening 58 created by the first and second arms 54, 56 of the stop bracket 50. Preferably an eccentrically shaped cam 66 provides the stop. The cam 66 includes an opening 68 for mounting to a cam pin 70. The cam 66 is fabricated to have a precise predetermined width 72. The opening 58 of the stop bracket 50 is fabricated to have a precise predetermined width 74 between inner surfaces of the first and second arms. The limp home throttle valve position is selected based on application specific criteria. A difference between the predetermined width 74 of the opening 58 and the predetermined width 72 of the cam 66 corresponds to the difference in throttle valve position between the closed throttle position and the limp home throttle position. The width 74 of the opening 58 and the width 72 of the cam 66 are predetermined for each specific application to provide the desired limp home throttle valve 14 position.

The linkage assembly 22 may be fabricated from any type materials known in the art. This includes plastic, metal, and the like. Specific considerations must be made for maintaining dimensional stability of the width 74 of the opening 58 of the stop bracket 50 and the width 72 of the cam 66. Further, considerations must be made in the selection of material for the stop bracket 50 and the sector gear 36 to minimize any friction at the point of contact 64.

A biasing member is disposed between the stop bracket 50 and a mount 76 attached to the housing 24. The biasing member in the preferred embodiment is a compression spring 78. The spring 78 biases the inner surface of the first arm 54 against the cam 66. The spring 78 exerts a force to overcome the closed throttle spring and any frictional resistance present in the linkage assembly 22 when the ETC assembly 20 is disabled. The force exerted by the spring 78 provides for a minimum of hysteresis of the limp home throttle valve position. The spring 78 forces the throttle valve into the limp home position from any throttle valve position. The spring 78 exerts sufficient force to overcome any resistance present within the linkage assembly 22 such that the precise limp home throttle position will consistently be obtained with minimal variation.

In operation the linkage assembly 22 is set to stop the sector gear 36 and thereby the first shaft 18 and the throttle valve 14 within the bore 16 at the closed throttle valve position. Driving the sector gear 36 against the stop bracket 50 such that the spring 78 is compressed and the inner surface of the second arm 56 is in contact with the cam 66 sets the closed throttle position. In operation, the ETC can drive the throttle valve to any open position as demanded by the vehicle.

Cam 66 can be rotated to set the sector gear 36 to a desired closed throttle valve position. Once the proper closed throttle valve position is attained, the cam 66 is locked down to prevent further rotation or movement. Locking the cam 66 prevents any further rotation that would change the closed throttle position. The cam 66 may be locked down using any method known to those skilled in the art.

Figure 4:
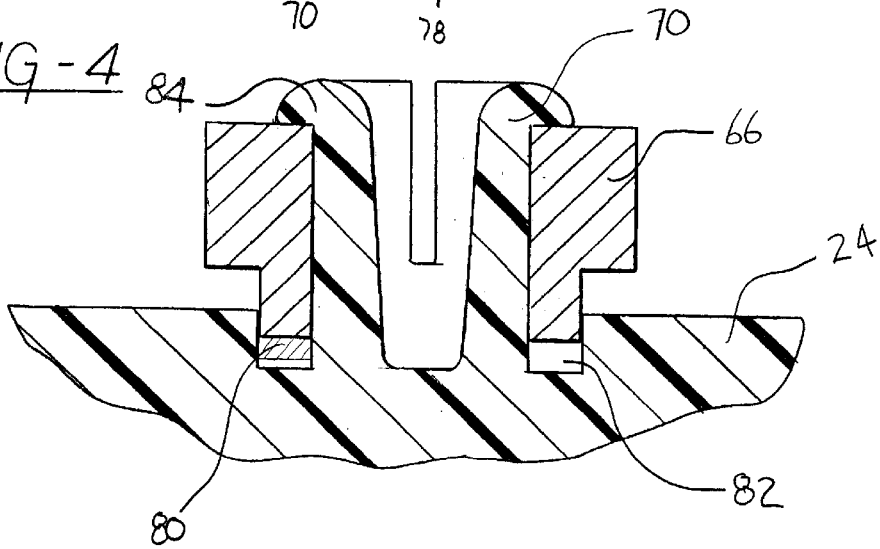
FIG. 4 is a cross-sectional view of an alternate cam-locking feature.

Referring to FIG. 4, an embodiment of mounting and locking the cam 66 is shown. The cam 66 is fabricated from a steel material to have teeth 80. The housing 24 is fabricated from a plastic material. The housing 24 would include an annular groove 82, which receives the teeth 80 of the cam 66. The cam pin 70 is also fabricated from plastic. The cam 66 fits over the cam pin 70 extending upward from the housing 24. The cam 66 is then rotated to attain the proper closed throttle valve 14 position. Once the cam 66 is properly positioned a top portion 84 of the cam pin 70 is staked over a top part of the cam 66 and the teeth 80 of the cam 66 are set into a bottom of the annular groove 82. The staking of the cam 66, and setting of the teeth 80 prevent rotation that may cause the closed throttle valve 14 position to change. It should be understood that it is within the contemplation of the subject invention that any type of staking or locking method may be utilized to prevent rotation of the cam 66 after setting of the closed throttle valve position.

The throttle valve limp home position is attained when the electric motor 26 of the ETC assembly 20 is disabled. The closed throttle valve position is attained because the force of the electric motor 26 will overcome the spring 78 and allow the sector gear 36 to rotate and push the second arm 56 of the stop bracket 50 into contact with the cam 66. Upon disablement of the electric motor 26 the throttle return spring 88 rotates the sector gear 36 into contact with the second arm 56 of the stop bracket 50. The throttle return spring 88 does not exert enough force to overcome the spring 78 and move the stop bracket 50 to the closed throttle valve position. The sector gear 36 therefore remains in the throttle valve limp home position, thereby providing sufficient power to allow a driver to maneuver the vehicle.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. An electronically controlled throttle valve for a motor vehicle comprising:

a shaft fixed to rotate a throttle valve;

a stop bracket to set a closed throttle valve position;

a cam to limit movement of said stop bracket at a limp home throttle valve position a fixed distance from the closed throttle valve position.

2. The assembly of claim 1, wherein said cam includes a locking mechanism, said cam rotated to set said closed throttle valve position then locked in place to maintain said closed throttle position by said locking mechanism.

3. The assembly of claim 1, further including a lever attached to said shaft and wherein said electronically controlled throttle valve assembly includes an electric motor, said electric motor drives said lever to rotate said shaft and throttle valve between said closed position and an open throttle valve position.

4. The assembly of claim 3, further including a first biasing member to bias said stop bracket to said limp home throttle valve position, and a second biasing member to bias said lever and throttle valve in said closed throttle position.

5. An electronically controlled throttle valve for a motor vehicle comprising:

a first shaft fixed to rotate a throttle valve;

a lever attached to rotate said first shaft;

a drive for driving said lever;

a stop bracket for limiting rotation of said lever having first and second arms defining an opening therebetween;

a stop for limiting movement of said stop bracket and disposed within said opening;

a first biasing member for biasing said stop bracket against said stop;

said stop bracket movable between a closed throttle valve position and a limp home throttle valve position, where said closed position is obtained by said drive driving said lever to overcome said first biasing member, and said limp home throttle valve position is attained when said drive is disabled and cannot overcome said first biasing member.

6. The assembly of claim 5, wherein said opening includes a width and said stop includes a width, and a difference between said width of said opening and said width of said stop defines the limp home throttle valve position relative to said closed throttle position such that said throttle valve is opened a predetermined amount to provide for limited operation of the vehicle upon disablement of said drive.

7. The assembly of claim 5, wherein said stop bracket includes a pivot arm portion pivotally secured to a pivot pin mounted to said housing, and said first and second arms extend from said pivot arm portion.

8. The assembly of claim 5, further including a second biasing member to bias said lever against said stop bracket, said second biasing member includes a lesser biasing force than said first biasing member.

9. The assembly of claim 5, wherein said stop comprises a cam, and rotation of said cam adjusts said closed throttle valve position of said stop bracket.

10. The assembly of claim 9, wherein said cam is eccentrically shaped.

11. The assembly of claim 10 wherein said cam includes a locking mechanism to prevent rotation of said cam once said closed throttle valve position has been adjusted.

12. The assembly of claim 11 wherein said cam is mounted to a plastic pin, and said plastic pin includes a portion that extends above said cam, and said portion of said pin extending above said stop is staked over to lock said cam after attaining said desired closed throttle valve position.

13. The assembly of claim 12, wherein said locking mechanism includes an annular groove in said housing, and said cam including a plurality of teeth configured to fit into said annular groove of said housing such that upon attaining a desired closed throttle valve position said plurality of teeth of said cam are staked within said annular groove to prevent movement of said cam.

14. The assembly of claim 5, wherein said lever comprises a sector gear and said drive is an electric motor having a drive shaft.

15. The assembly of claim 14, further including a first drive gear attached to said drive shaft and a second drive gear having first and second sets of gear teeth, wherein said first drive gear engages said first set of gear teeth of said second drive gear and said second set of gear teeth of said second drive gear engages said sector gear.

16. The assembly of claim 5, further including a throttle body having a bore for intake of air, and said first shaft extends through said bore and a throttle valve for regulating the intake of air through said bore is attached to said first shaft.

17. The assembly of claim 5, wherein said first biasing member is a linear spring.

* * * * *